US006055677A

United States Patent [19]

McKinley

[11] Patent Number: 6,055,677

[45] Date of Patent: May 2, 2000

[54] VENTED COMMODE

[76] Inventor: Don McKinley, P.O. Box 754, Tucumcari, N. Mex. 88401

[21] Appl. No.: 09/067,253

[22] Filed: Apr. 27, 1998

[51] Int. Cl.[7] ..... E03D 9/052

[52] U.S. Cl. ..... 4/217

[58] Field of Search ..... 4/213, 217

[56] References Cited

U.S. PATENT DOCUMENTS

| | | | |
|---|---|---|---|
| 1,261,561 | 4/1918 | Landmann | 4/349 |
| 1,424,955 | 8/1922 | Van Eck | 4/213 |
| 1,563,691 | 12/1925 | De Cola | 4/352 |
| 2,079,733 | 5/1937 | Cummings | 4/217 |
| 2,094,302 | 9/1937 | Priess | 4/216 |
| 2,286,555 | 6/1942 | Long | 4/213 |
| 2,452,282 | 10/1948 | Auer | 4/216 |
| 3,064,274 | 11/1962 | Gleason | 4/216 |
| 3,108,289 | 10/1963 | Smith | 4/213 |
| 3,416,167 | 12/1968 | Klemme | 4/217 |
| 3,805,304 | 4/1974 | Ikehata | 4/213 X |
| 3,902,203 | 9/1975 | Poister et al. | 4/213 |
| 4,200,940 | 5/1980 | Buchanan | 4/348 |
| 4,251,888 | 2/1981 | Turner | 4/213 |
| 4,556,999 | 12/1985 | Lindley | 4/217 |
| 5,136,730 | 8/1992 | Casale | 4/213 |

FOREIGN PATENT DOCUMENTS

| | | | |
|---|---|---|---|
| 2266901 | 11/1993 | United Kingdom | 4/217 |

*Primary Examiner*—Robert M. Fetsuga
*Attorney, Agent, or Firm*—Cahill, Sutton & Thomas, P.L.C.

[57] ABSTRACT

A hollow toilet seat having a plurality of inlets in its bottom surface is pivotably secured to a hollow attachment device mounted on a commode. Slots in the toilet seat are in positional correspondence with slots in the attachment device to provide fluid communication for air/gas flow from within the commode, through the inlets into the toilet seat and to the attachment device at least when the toilet seat is in the down position adjacent the bowl of the commode. A selectively operated vacuum pump is in fluid communication with the attachment device draws air/gas from within the bowl of the commode to an exhaust location.

2 Claims, 3 Drawing Sheets

VENTED COMMODE

BACKGROUND OF THE INVENTION

1. Field of the Invention

The present invention relates to exhaust systems for commodes and, more particularly, to a commode seat assembly for removing noxious fumes from a commode bowl and exhausting the fumes to a remote location.

2. Description of Related Art

Noxious odors and gaseous fumes present in commodes and in the space about commodes have always been normal but an unpleasant result attendant commode use. These odors and fumes are especially prevalent in areas containing many commodes and in a small bathroom containing a single commode. Over the years, various venting systems have been developed to remove the odors resulting from normal commode use. These systems have worked with greater or lesser degrees of success, depending upon their design and configuration of components. In most cases, each of the prior art commode venting systems has required a specially configured bowl to collect and channel odors in response to operation of a gas exhaust system. To implement such apparatus requires replacement of an existing commode, which may involve new plumbing fixtures or at least detachment and reattachment of water and sewage lines. The labor for such removal and installation work is expensive and the costs for replacing a commode are not insignificant.

Another group of prior art devices includes a plenum chamber disposed within a pivotally mounted toilet seat. The chamber is in fluid communication with the interior of the toilet bowl through a plurality of apertures disposed about the interior surface of the toilet seat. These devices require complicated and expensive exhaust handling apparatus. Moreover, the attendant structures impose upon the space about the commode to an extent sufficient to be considered intrusive.

SUMMARY OF THE INVENTION

A toilet seat of essentially conventional configuration for replacing existing toilet seats includes a plenum having a plurality of apertures disposed in the bottom surface for channeling air and unpleasant gases into the plenum. The plenum is in fluid communication with a hollow pivotally attached toilet seat attachment device defining a further plenum. Communication therebetween is provided through apertures in a pivot mechanism in correspondence with one another when the toilet seat is in the down position. An exhaust system, selectively actuatable, draws air and gases from the plenum of the attachment device for venting through appropriate conduits to the atmosphere or other discharge location.

It is therefore a primary object of the present invention to provide a venting device for commodes.

Another object of the present invention is to provide an inexpensive replacement toilet seat for venting commodes.

Still another object of the present invention is to provide an attachment device for a hollow toilet seat to draw odors from the commode through the toilet seat for venting to the atmosphere.

Yet another object of the present invention is to provide a selectively actuatable venting system for conventional commodes.

A further object of the present invention is to provide a vented toilet seat for removing odors from within a commode bowl, which toilet seat is readily installable by a user.

A still further object of the present invention is to provide a toilet seat and attachment device attachable to existing standard commode bowls for venting odors from within the commode bowl.

A yet further object of the present invention is to provide an inexpensive, easily installable method for venting commodes.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
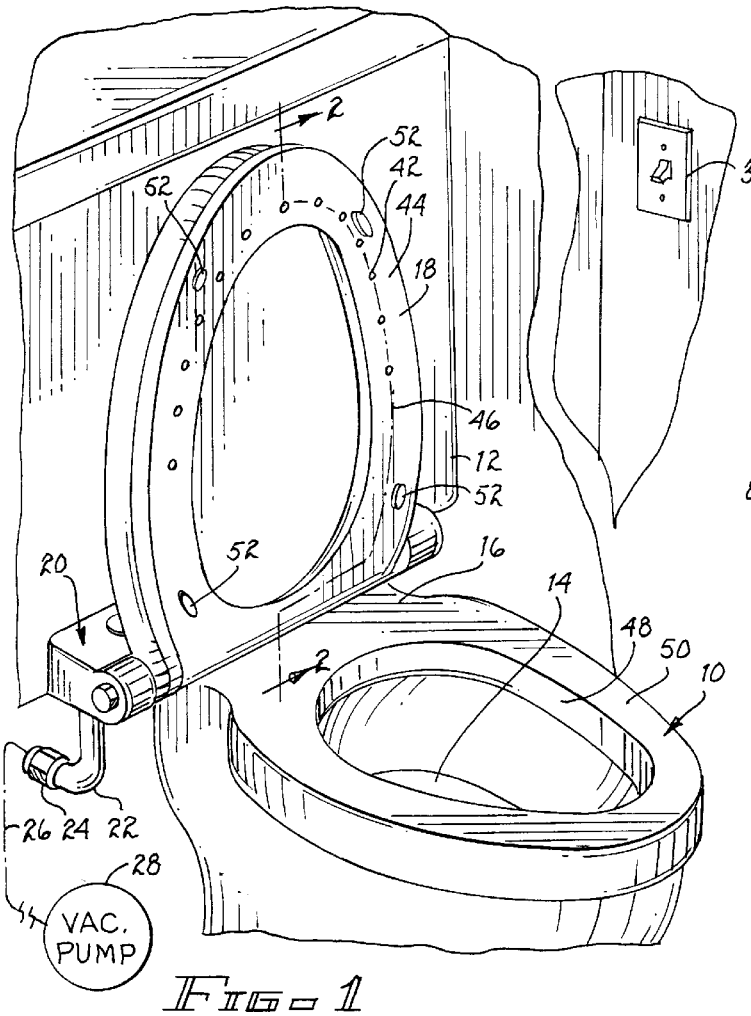
FIG. 1 illustrates a conventional commode having a vented toilet seat attached thereto and shown in the raised position.

Referring to FIG. 1, there is shown a conventional commode bowl 10 having a rearwardly located water tank 12 of conventional construction. The flushing of the commode bowl operates in the normal manner with subsequent partial fill of water 14. The rear planar surface of the commode bowl includes a pair of conventional holes for receiving bolts to secure a pivot mechanism pivotally attached to the toilet seat and lid (when used). Instead of a conventional pivot mechanism, the present invention incorporates a toilet seat attachment device 20 which is essentially hollow. A hollow stud 22 extends from the lower surface of the attachment device, which stud may be straight or may include a rearwardly oriented bend, as illustrated. At the terminal end of the hollow stud, there is located a coupling 24 for attaching a hollow conduit 26 in fluid communication with a vacuum pump 28. Upon operation of the vacuum pump, air/gases are drawn from within attachment device 20 through the stud and the conduit for venting the air/gases to the atmosphere or other exhaust location. Operation of the vacuum pump may be controlled through a switch 30 that may be formed as part of or in conjunction with a light switch for the bathroom. Alternatively, the switch may be located adjacent the commode to permit selective operation of the vacuum pump by a user of the commode.

Further details of toilet seat 18 will be described with particular reference to FIGS. 2, 2A, 3 and 4. The toilet seat is essentially hollow and defines a plenum 40 having a plurality of inlets 42 disposed in lower surface 44. These inlets may be centered upon a curved line 46 which may be essentially coincident with the perimeter of interior wall 48 at the top of commode bowl 10; note FIG. 1. These inlets may extend about the toilet seat or may be deleted from the rear portion of the toilet seat. To prevent inflow of clean or waste water into the inlets due to splashing, line 46 may be outwardly laterally displaced from the perimeter of interior wall 48 to a location essentially coincident with top surface 50 of the commode bowl. As the toilet seat may include a plurality of bumpers 52 to maintain the toilet seat in upwardly disposed relationship with top surface 50 of the commode bowl when the seat is lowered, fluid communication between the interior of the commode bowl and inlets 42 is maintained.

Attachment device 20 is essentially hollow and includes a plenum 60 in fluid communication with stud 22. The attachment device is attached to commode bowl 10 by means of a pair of conventional bolts 62 penetrably engaging holes 64 extending through attachment device 20 and corresponding holes at the rear of a conventional commode bowl. These bolts are secured in place by conventional nuts or the like. Attachment device 20 includes a pair of laterally located forwardly extending tangs 66 and 68 and a centrally located protrusion 70, which form, in combination, one part of a hinge. The rear of toilet seat 18 includes a pair of spaced-apart protrusions 72,74 locatable intermediate protrusion 70 and the respective one of tangs 66,68 and form another part of the hinge. A common pivot pin 76 is in penetrable engagement with corresponding apertures in tangs 66,68 and protrusions 70, 72, 74 to pivotally connect, in the manner of a hinge, toilet seat 18 with attachment device 20. A lid 20 may be employed in the conventional manner to cover the toilet seat during non-use of the commode. The toilet seat includes a pair of further tangs 82 positionable intermediate tang 66, protrusion 72, and intermediate tang 68 and protrusion 74, respectively; the lid is also pivotally secured in place by pin 76 penetrably engaging apertures in lid tangs 82.

Figure 2:
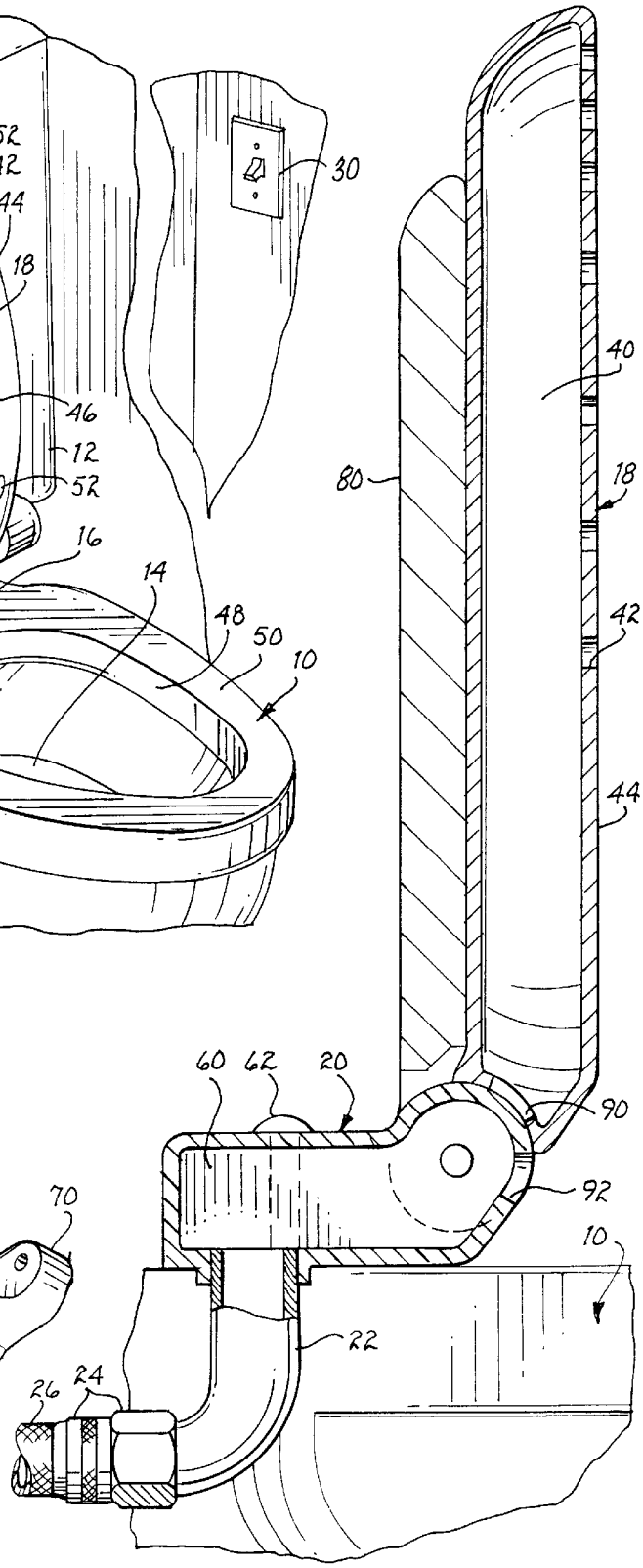
FIG. 2 is a cross-sectional view taken along lines 2—2, as shown in FIG. 1.

The rear edge of toilet seat 18 includes a slot 90 in fluid communication with plenum 40 within the toilet seat. Protrusion 70 also includes a slot 92 in communication with plenum 60 within attachment device 20. In the downward position of toilet seat 18, as depicted by arrow 94 in FIG. 2A, slot 90 is essentially coincident with slot 92. Accordingly, fluid communication between plenums 40 and 60 is established by these two slots. In the upright position of the toilet seat, as depicted in FIG. 2, slots 90 and 92 may be out of registration with one another. Upon energization of vacuum pump 28 when the toilet seat is in the down position (see FIG. 2A), gases are drawn from within the commode bowl through inlets 42, plenum 40, slots 90,92, plenum 60, and into hollow stud 22 for evacuation via coupling 24 and conduit 26 (see FIG. 1).

Figure 5:
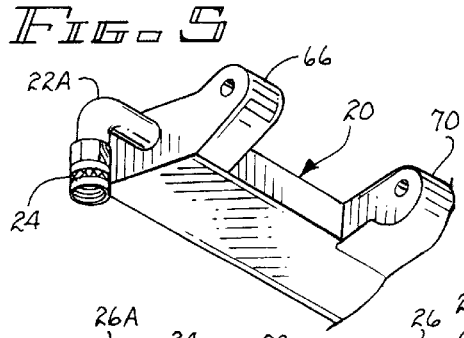
FIG. 5 illustrates a variant hollow stub for exhausting gases from within the toilet seat attachment device.
Figure 6:
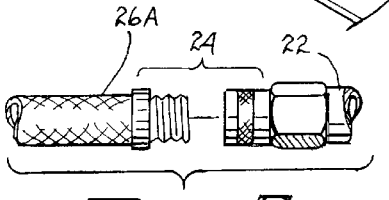
FIG. 6 illustrates connection of a conventional garden hose as part of a gas exhaust system.

Hollow stud 22 is preferably oriented as shown in FIG. 1 to minimize intrusion into the space around the commode and to render it as inconspicuous as possible. However, at certain installations stud 22A may extend laterally and downwardly, as shown in FIG. 5. Other orientations of stud 22 are contemplated. For ease of installation and to minimize costs, conduit 26 may be a length of garden hose 26A, as shown in FIG. 6. Coupling 24 may be a conventional threaded coupling or it may be a quick disconnect fitting readily available in the marketplace.

Figure 9A:
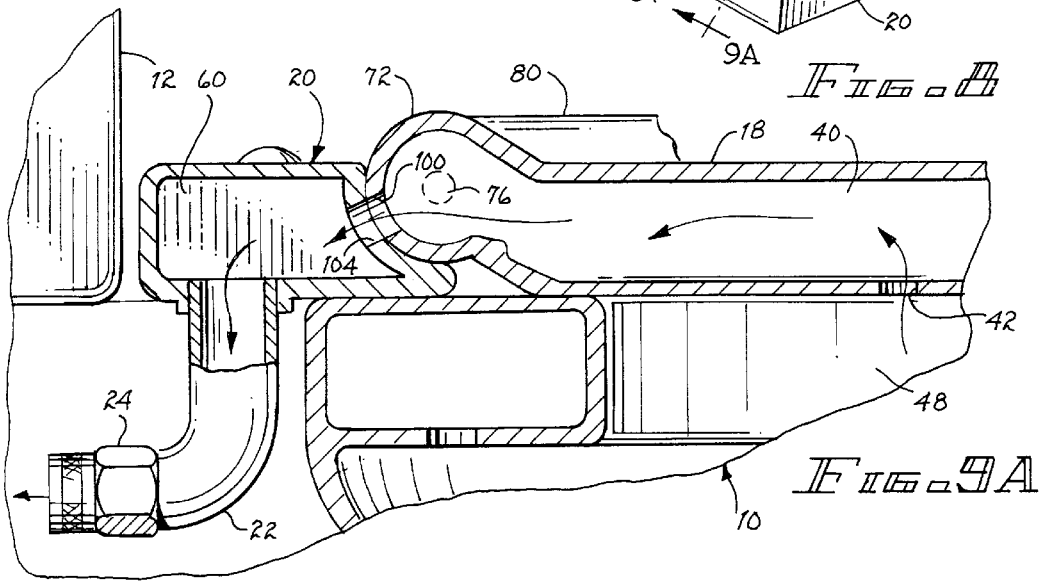
FIG. 9A is a partial cross-sectional view taken along lines 9A—9A shown in FIG. 8 and illustrating the flow of gases when the variant toilet seat is in the down position.

To increase the gaseous flow rate evacuation from within the commode bowl, protrusions 72,74 include slots 100,102 in fluid communication with plenum 40 within the variant toilet seat shown in FIGS. 7, 8, 9A and 9B. Attachment device 20 includes further slots 104,106, disposed in the side walls between tang 66 and protrusion 70 and between protrusion 70 and tang 68. Slots 104,106 are in fluid communication with plenum 60; note FIG. 7. As depicted in FIG. 9A, when seat 18 is in its lowered position, slot 100 is in fluid communication with slot 104 to provide fluid communication between plenum 40 in the seat and plenum 60 in the attachment device. It is to be understood that a similar fluid communication exists between slot 102 and slot 106 and between earlier described slots 90,92. With this arrangement, the cross-sectional area of flow between plenum 40 in the toilet seat and plenum 60 in the attachment device has been tripled over the cross-sectional area of the embodiment illustrated in FIGS. 2A, 3 and 4.

Figure 9B:
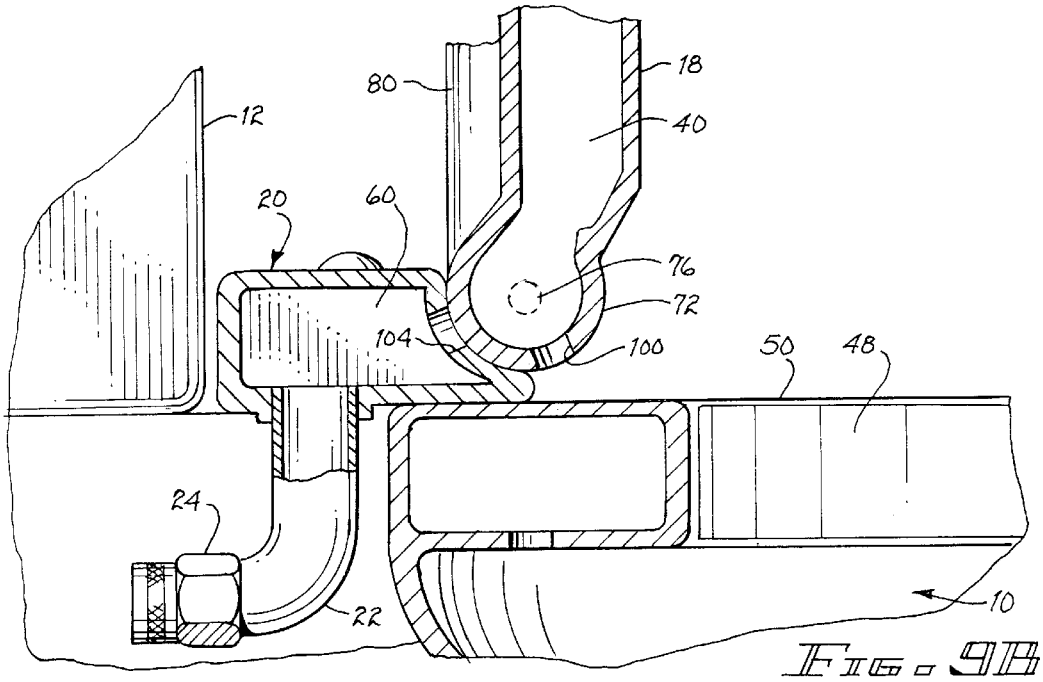
FIG. 9B is a partial cross-sectional view of the variant toilet seat shown in FIG. 9A when the variant toilet seat is in the raised position.

FIG. 9B is similar to FIG. 2 and illustrates termination of fluid communication between plenum 40 and plenum 60 due to displacement of the slots in communication with plenum 40 from the slots in communication with plenum 60.

Figure 2A:
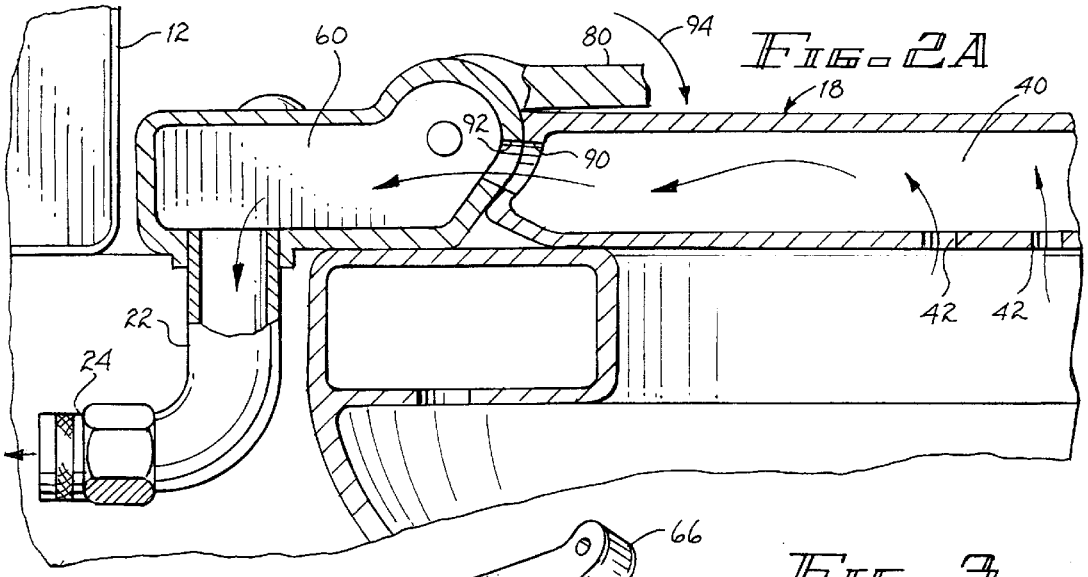
FIG. 2A is a partial cross-sectional view illustrating the flow of gases during operation of the vented toilet seat in the down position.
Figure 3:
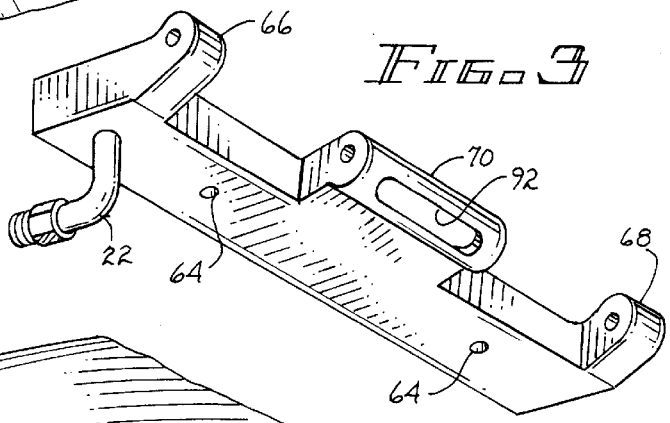
FIG. 3 is a perspective view of a hollow toilet seat attachment device.
Figure 4:
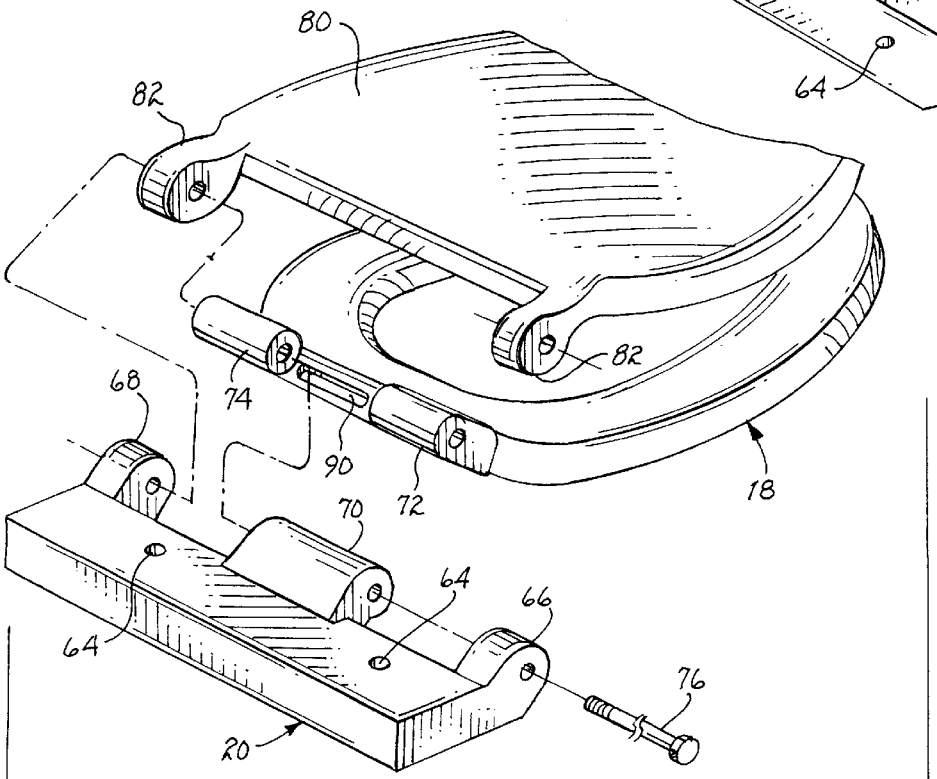
FIG. 4 is an isometric view of the components and the method of pivotally mounting the vented toilet seat.
Figure 7:
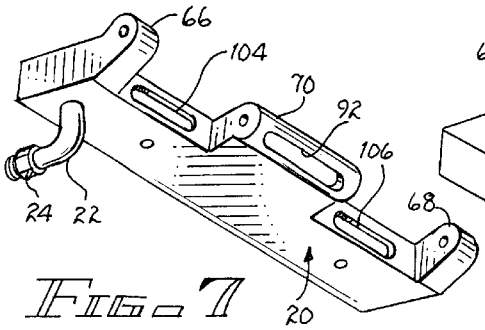
FIG. 7 illustrates a variant toilet seat attachment device.
Figure 8:
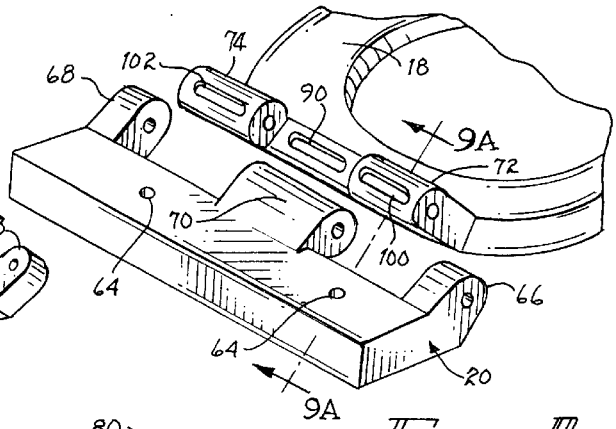
FIG. 8 illustrates a variant toilet seat cooperating with the variant attachment device shown in FIG. 7.

As shown in FIGS. 2 and 2A, the sections of toilet seat 18 adjacent protrusion 70 of attachment device 20 may be curved to conform with curvature of the protrusion and thereby reduce air flow losses between slots 90 and 92. This construction is different from the planar configuration of the same section of the toilet seat shown in FIGS. 4 and 8. Similarly, the sections of attachment device 20 between protrusion 70 and each of tangs 66,68 may be curved to conform with the curvature of corresponding protrusions 72,74 of the toilet seat, as shown in FIGS. 9A and 9B, to enhance air flow between the corresponding slots. This construction is also different from the planar configurations of the same sections of the attachment device shown in FIGS. 3 and 7. Whether the protrusion mating sections are planar or curved is a function of manufacturing expedience and costs.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

What is claimed is:

1. Apparatus for extracting and conveying gases from within the bowl of a commode to a remote location, said apparatus comprising in combination:

a) a vented pivotable toilet seat having an upper surface and a lower surface, said toilet seat being pivotable between a down position and an up position;

b) a first plenum disposed within the interior of said toilet seat, including a plurality of inlets disposed in the lower surface adapted to draw gases from within the bowl into said first plenum when said toilet seat is in a down position;

c) first and second protrusions extending rearwardly from said toilet seat;

d) a first slot disposed at the rear of said toilet seat intermediate said first and second protrusions and in fluid communication with said first plenum for exhausting gas from said first plenum;

e) an attachment device adapted to be secured to the commode for pivotally supporting said toilet seat, said attachment device including a second plenum;

f) a third hollow protrusion in fluid communication with said second plenum and extending forwardly from said attachment device toward the bowl, said third protrusion including a second slot for receiving gases from said first plenum through said first slot and for conveying the received gases to said second plenum;

g) a pair of tangs extending forwardly from said attachment device bracketing said third protrusion in spaced relationship therewith to locate one of said first and second protrusions intermediate said third protrusion and a tang of said pair of tangs and to locate the other one of said first and second protrusions intermediate said third protrusion and the other tang of said pair of tangs;

h) pivot means for pivoting said toilet seat relative to the bowl about an axis common with said pair of tangs, said first and second protrusions and said third protrusion to juxtapose said first slot with said second when said toilet seat is in the down position; and i) means for exhausting gases from said second plenum to a remote location.

2. The apparatus as set forth in claim 1 wherein said first and second protrusions are hollow and in fluid communication with said first plenum, said first and second protrusions including third and fourth slots, respectively, for exhausting gases from said first and second protrusions; and said attachment device including fifth and sixth slots disposed between said third protrusion and one tang of said pair of tangs and between said third protrusion and the other tang of said pair of tangs, respectively, said fifth and sixth slots being juxtaposed with said third and fourth slots, respectively, upon placement of said toilet seat in the down position to establish fluid communication between said first and second plenums through said third and fourth slots and through said fourth and sixth slots, respectively.

* * * * *